US006226489B1

(12) United States Patent
Eelen et al.

(10) Patent No.: US 6,226,489 B1
(45) Date of Patent: May 1, 2001

(54) FIXING DEVICE FOR FIXING TONER IMAGES ONTO A RECEIVING MATERIAL

(75) Inventors: Peter Eelen, Zoersel; Kris Nuyts, Sint-Amands; Ludo Verluyten, Holsbeek; Dirk Broddin, Edegem, all of (BE)

(73) Assignee: Xeikon NV, Mortsel (BE)

( * ) Notice: Subject to any disclaimer, the term of this patent is extended or adjusted under 35 U.S.C. 154(b) by 0 days.

(21) Appl. No.: 09/488,555

(22) Filed: Jan. 21, 2000

(30) Foreign Application Priority Data

Jan. 23, 1999 (GB) ..... 9901396

(51) Int. Cl.[7] ..... G03G 15/00; A47L 13/40

(52) U.S. Cl. ..... 399/327; 15/1.51; 399/71

(58) Field of Search ..... 15/1.51; 118/104, 118/60, 70; 432/75; 399/71, 327, 345, 347, 352, 358

(56) References Cited

U.S. PATENT DOCUMENTS 4,013,400 * 3/1977 Thettu et al. ..... 399/327
4,018,555 4/1977 Thettu .
4,705,388 11/1987 Huntjens et al. .
5,678,134 * 10/1997 Miki et al. ..... 399/327

FOREIGN PATENT DOCUMENTS 0373651 6/1990 (EP) .

* cited by examiner

*Primary Examiner*—Arthur T. Grimley
*Assistant Examiner*—Hoang Ngo
(74) *Attorney, Agent, or Firm*—Larson & Taylor PLC

(57) ABSTRACT

The device includes an endless fixing member urged into contact with an endless counter member to form a fixing nip therebetween through which a receiving material path extends. A cleaning member having a tacky surface is in contact with the surface of the fixing member to remove debris therefrom. Polymer material particles are applied to the cleaning member to render the surface tacky. A radiant heating device heats the polymer material particles on the cleaning member surface to render the surface tacky prior to contact of the cleaning member surface with the fixing member surface. Debris, especially paper dust, can thereby be reliably removed from the fixing member.

17 Claims, 2 Drawing Sheets

FIXING DEVICE FOR FIXING TONER IMAGES ONTO A RECEIVING MATERIAL

FIELD OF THE INVENTION

The present invention is directed to a fixing device for fixing toner images onto a receiving material, and to a method of removing debris from the surface of an endless fixing member of such a fixing device.

BACKGROUND OF THE INVENTION

In an electronic printer, where toner particles are deposited on a surface in image form and are subsequently transferred to a receiving material, such as paper, the toner particles must be fixed onto the receiving material in order to render the images permanent. This fixing process is often achieved by a combination of heat and pressure applied in a fixing nip. For example, the receiving material onto which unfixed toner particles have already been deposited, is passed through the fixing nip where an increased temperature and pressure serve to fix the image permanently to the receiving material. Alternatively, a transfer surface carrying the unfixed toner particles is fed through the fixing nip together with the receiving material, whereby the increased temperature and pressure cause the transfer of the toner particles from the transfer surface to the receiving material and the simultaneous fixing of the toner image thereon.

In such devices, especially where the receiving material is formed of paper or a like fibrous material, debris in the form of dust and fibers can build up in the region of the fixing nip. If this debris remains, the quality of fixing, and the efficiency of the image transfer where applicable, can be affected.

A fixing device is known, for example from European patent specification EP 149860 (Océ-Nederland BV) for fixing toner images onto a receiving material. The device comprises a fixing roller urged into contact with a pressure roller to form a fixing nip therebetween through which a copy sheet passes. A perforated cleaning roller is in contact with the surface of the fixing roller to remove debris therefrom. Toner particles are applied to the cleaning member to render the surface tacky.

In a fixing device described in United States patent U.S. Pat. No. 4,018,555 (Thettu/Xerox Corporation), a fuser roll is urged into contact with a backup roll to form a fixing nip therebetween through which copy paper or substrate material passes. An internally heated cleaning roll having a tacky surface is positioned in contact with the surface of the fixing roll to remove debris therefrom. The cleaning roll can be rejuvenated by the application thereto of a tacky polymeric adhesive.

U.S. Pat. No. 4,705,388 (Huntjens et al/Océ-Nederland BV) describes a method and device for determining the moment that a layer of tacky material on an internally heated cleaning roll needs to be rejuvenated.

We have found that the above mentioned fixing devices are not as successful at removing debris from the fixing nip as may be desired for high quality work. Thus it is an objective of the present invention to provide a device and method in which an improved removal of debris is possible.

SUMMARY OF THE INVENTION

We have discovered that this objective, and other useful advantages, can be obtained by heating the toner particles on the cleaning member surface with a controllable radiant heating device to render the surface tacky prior to contact of the cleaning member surface with the fixing member surface.

Thus, according to a first aspect of the invention, there is provided a fixing device for fixing toner images onto a receiving material, the device comprising an endless fixing member urged into contact with an endless counter member to form a fixing nip therebetween through which a receiving material path extends, a cleaning member having a tacky surface in contact with the surface of the fixing member to remove debris therefrom, means for applying polymer material particles to the cleaning member to render the surface tacky, and a controllable radiant heating device positioned adjacent the cleaning member surface for heating the polymer material particles on the cleaning member surface to render the surface tacky prior to contact of the cleaning member surface with the fixing member surface.

In a second aspect of the invention a fixing device for fixing toner images onto a receiving material is provided, the device comprising an endless fixing member urged into contact with an endless counter member to form a fixing nip therebetween through which a receiving material path extends, a retractable cleaning member having a tacky polymer surface in contact with the surface of said fixing member, and a controllable radiant heating device positioned adjacent the cleaning member surface for heating said polymer on said cleaning member surface to adjust the tackiness thereof prior to contact of said cleaning member surface with said fixing member surface.

According to a third aspect of the invention, there is provided a method of removing debris from the surface of an endless fixing member of a fixing device in which the fixing member is urged into contact with an endless counter member to form a fixing nip therebetween through which receiving material passes, the method comprising contacting the surface of the fixing member with a cleaning member having a tacky surface, applying polymer material particles to the cleaning member, and heating the polymer material particles on the cleaning member surface in a controlled way by use of a radiant heating device positioned adjacent the cleaning member surface to render the surface tacky prior to contact of the cleaning member surface with the fixing member surface.

The fixing member preferably has an elastomeric outer layer consisting of, or coated with, a silicone material. The elastomeric outer layer enables the fixing member to exert a pressure against the counter member at the fixing nip which is optimum for the fixing of the toner particle image.

The fixing member may be in the form of a belt or a drum.

In the case where the fixing member is a belt, preferably this belt comprises an electrically conductive backing member covered with e.g. a silicone elastomer, polytetrafluoroethylene, fluorsilicones, polyfluoralkylene and other fluorinated polymers. On top, a semi-insulating or insulating coating layer, e.g. a fluorsilicone, may be formed. Alternately, a (reinforced) fabric backing may be used covered with a conductive (conformable) silicone layer, optionally covered with a top coating.

The invention is most applicable where the fixing member surface is dry, that is it is not supplied with a liquid release agent such as silicone oil.

The counter member may be in the form of a counter roller, although the use of a counter belt is also possible.

The cleaning surface is preferably an endless surface, such as the surface of a cleaning roller, although the use of a cleaning belt is also possible.

The cleaning roller may comprise a rigid core optionally provided with a conformable layer provided thereon. The inner core may be partly hollow or comprise at least one cavity, while the outer surface is perforated. In the latter case, the perforations extend throughout the conformable layer. The tacky surface layer is formed on the inner core or on the conformable layer, if present. The decision whether or not to provide a conformable layer depends on the conformability of the fixing member. The conformable covering preferably has a hardness of less than 80, most preferably less than 70, Shore A and a thickness of at least 1.0 mm, most preferably at least 2.0 mm. These requirements enable the cleaning roller to exert a pressure on the fixing member which is optimum for the removal of debris therefrom. Conductive fillers may be included in the conformable covering of the cleaning roller to control the electrical resistance thereof.

The cleaning member may be a cleaning roller which co-operates with a back-up roller to form a cleaning nip therebetween through which the transfer belt passes, downstream of the fixing nip. Means may be provided to adjust the pressure exerted between the cleaning roller and the back-up roller at the cleaning nip.

Heating the polymer material particles on the cleaning member surface has several benefits. By heating the polymer on the surface of the cleaning member prior to the contact thereof with the fixing member, it is possible to render this surface in an optimal tacky condition for the most effective removal of debris from the fixing member. The heating device can be energized selectively to control the temperature and tackiness of the cleaning member surface. This is especially beneficial at start up where, in the absence of such a heating device, it would take a significant amount of time (and possibly wastage of receiving material) before the temperature equilibria would be reached. Furthermore, the heating device plays a central role in the preparation of the cleaning member surface for rejuvenation or removal of excess polymer material, as will be described in further detail below. The heating of the polymer material is carried out with the use of a radiant heating device positioned adjacent the cleaning member. This option is preferred to that of heating the interior of the cleaning member for several reasons. One of them is the possibility to more accurately control the temperature of the cleaning member surface. Another one is a greater freedom in composition of the cleaning member. For instance, in the case where a relatively thin transfuse belt is used, i.e. typically 400 $\mu$m or below, the cleaning member is preferably conformable. In particular, a cleaning roller can be used with an inner core covered with a conformable layer. If heating were to be applied internally, more heat would have to be applied to achieve the same surface temperature at the cleaning roller surface and moreover the material of which this conformable layer is composed of would have to be a material which can sustain high temperatures, which has a relatively high heat conductance and delamination of this material from the inner core would need to be avoided. These are quite severe requirements which, even if they can be met, will result in an expensive and less reliable solution. In other words the lifetime of the cleaning roller might still be an issue. Furthermore, in the case where a perforated roller with a cavity inside is used as the cleaning roller, internal heating should definitely be avoided. Such a perforated roller has the advantage that debris, residual polymer material and excess polymer material can be collected in a cavity inside said roller. In the case where the roller is heated internally the heat has to be transported through this waste to the roller surface which will be very inefficient. An even bigger problem is that such an internal heating would keep the waste polymer material in a fluid or at least softened state, so that this waste can easily come out of the roller through the perforations thereby inhibiting the proper functioning of the cleaning roller. This is not an issue when using an external heating source, as heat has only to be applied to the surface of the cleaning roller.

Means are provided for controlling the heating of the polymer material particles, for example by the use of a heat sensor to sense the temperature of the cleaning member surface, this sensor being coupled to a control device for the heating device.

The tacky surface layer is formed of polymeric material having good adhesive and adsorptive properties, especially at the operating temperatures of the fixing member. This polymeric material is preferably selected from polymers having a glass transition temperature below the temperature of the fixing member at the cleaning nip.

The polymer material particles which are applied to the cleaning member to form the tacky surface thereon, may be toner particles and may have the same composition as the toner particles which form the image to be fixed on the receiving member. The device which is used to form the toner particle images may be so programmed to provide the toner particles to be applied to the cleaning member.

The toner particles used in the present invention can be of any suitable form with respect to their composition, shape, size and method of preparation and the sign of their triboelectrically acquired charge.

Dry-development toners typically comprise a thermoplastic binder consisting of a thermoplastic resin or mixture of resins including coloring matter, e.g. carbon black or coloring material such as finely dispersed pigments or soluble dyes.

The mean diameter of dry toner particles for use in magnetic brush development is conventionally about 10 $\mu$m (ref. "Principles of Non Impact Printing" by Jerome L. Johnson —Palatino Press Irvine Calf. 92715 U.S.A. (1986), p. 64–85). For high resolution development the mean diameter may be from 1 to 5 $\mu$m (see e.g. British patent specification GB-A-2180948 and International patent specification WO-A-91/00548).

The thermoplastic resinous binder may be formed of polyester, polyethylene, polystyrene and copolymers thereof, e.g. styrene-acrylic resin, styrene-butadiene resin, acrylate and methacrylate resins, polyvinyl chloride resin, vinyl acetate resin, copoly(vinyl chloride-vinyl acetate) resin, copoly(vinyl chloride-vinyl acetate-maleic acid) resin, vinyl butyral resins, polyvinyl alcohol resins, polyurethane resins, polyimide resins, polyamide resins and polyester resins. Such resins usually have a glass transition point of more than 45° C., usually above 54° C. The presence of other ingredients in the toner particles, such as the colorant, usually have no significant effect upon the glass transition temperature. The volume resistivity of the resins is preferably at least $10^{13}$ Ω-cm.

Suitable toner compositions are described in European patent applications EP-A-601235, and EP-A-628883 and International patent applications WO 94/27192, 94/27191 and 94/29770 (all Agfa-Gevaert NV) and U.S. Pat. No. 5,825,504 (assigned to Agfa-Gevaert NV).

The glass transition temperature (softening point) of the toner composition is preferably between 50°C. and 70° C., such as about 55° C. and a melting point (fluid point), at which the viscosity falls below 500 Pa s, is within the range of 90° to 155° C., such as 120° C. to 150° C.

We prefer to use toners having a composition comprising a thermoplastic binder and up to 50%, such as from 1% to 10%, more preferably from 3% to 6% by weight, based on the weight of the toner composition, of a pigment. We also prefer that the toner composition in powder form has a number median diameter (dv50) of between 5 μm and 12 μm, preferably between 7 μm and 8 μm.

While the polymer material particles applied to the cleaning member may be the same as those used for forming the toner particle image, it is also possible to use polymer material particles of a different composition, for example containing a lower level of pigment, or even no pigment at all. However, where the pigment is, or includes, carbon black, this leads to an advantage with respect to the adsorption of molecular contaminants and for this reason toner particles containing carbon black, especially higher than usual levels of carbon black, are preferred.

The tacky polymer surface layer can be refreshed for instance by applying fresh polymer material in dry powder form onto the cleaning member.

An electrical bias between the surface of the cleaning member and the fixing member may be employed to assist removal of debris from the fixing member.

The method according to the invention may further comprise the subsequent step of removing built-up polymer material and debris from the cleaning member. This may be achieved by adjusting the temperature of the fixing member and the cleaning member to ensure transfer of the built-up polymer material and debris from the cleaning member to the fixing member and subsequently transferring the built-up polymer material and debris from the fixing member to a waste portion of the receiving material, or by cooling the cleaning member to harden the built-up polymer material and debris and subsequently mechanically removing the hardened built-up polymer material and debris from the cleaning member. This cooling may take place, for example, overnight, when the printing system is inactive. Alternatively, the cooling may be accelerated by a cooling fan or other forced cooling means such as the circulation of a cooling fluid through the core of the cleaning roller, where the cooling fluid may be air cooled or cooled using an active cooling system. In another embodiment the cooling roller may be removed, to be cleaned off-line.

The hardened built-up polymer material and debris may be removed from the cleaning member by abrasion and vacuum pick-up.

The cleaning member may be positioned to contact the fixing drum upstream of the fixing nip and may be selectively movable from a cleaning position in which the cleaning member surface is in contact with the fixing member surface into a toner pick-up position in which the cleaning member surface abuts the receiving material path.

Where the cleaning member is a cleaning roller, it may, in the toner pick-up position, co-operate with a back-up roller to form a toner pick-up nip therebetween through which the receiving material path extends, upstream of the fixing nip.

Means are preferably provided to adjust the pressure exerted between the cleaning roller and the back-up roller at the toner pick-up nip.

In this embodiment, the method may include selectively moving the cleaning member from a cleaning position in which the cleaning member surface may be in contact with the fixing member surface into a rejuvenation position in which the cleaning member surface may be contacted by the receiving material to enable the transfer of unfixed toner particles from the receiving material onto the cleaning member surface. Thus, the printer may be programmed to deposit a band of toner particles on the receiving member, to be transferred in the rejuvenation position, to the cleaning member. Transfer can be based on an adhesive transfer facilitated by a predetermined pressure at the rejuvenation position nip. The transfer may be assisted by electrostatic means (providing an earthed metal roller may induce an electrostatic force on the charged toner particles) or a DC bias field may be applied between the core of the cleaning roller and the metal core of the roller at the other side of the web. The band of toner particles may be of such a size as to ensure the application of toner particles to the whole cleaning member surface.

The counter member may be movable in a direction away from the transfer belt to selectively open the fixing nip.

The method may comprise selectively moving the counter member in a direction away from the fixing member to selectively open the fixing nip, thereby to prevent the fixing of toner particles on the receiving material and to enable the transfer of the toner particles onto the cleaning member surface. Thus, the printer may be programmed to deposit a band of toner particles on the fixing member, to be transferred to the cleaning member when the fixing nip is opened. The band of toner particles may be of such a size as to ensure the application of toner particles to the whole cleaning member surface.

The cleaning member may be selectively moved from a cleaning position in which the cleaning member surface is in contact with the fixing member surface into a retracted position in which the cleaning member surface is not in contact with the fixing member surface while toner images are being fixed in the fixing nip.

In one embodiment of the invention, unfixed toner particles in image form are carried on the receiving material and are fixed thereon as the receiving material passes through the fixing nip. In this embodiment, the fixing member is in a form of a drum. The unfixed toner particles may be deposited upon the receiving material by any means known in the art, such as described in U.S. Pat. No. 5,455,668 (De Bock et al./Xeikon NV).

In a second embodiment of the invention, unfixed toner particles in image form are carried on the fixing member and are transferred to the receiving material and fixed thereon as the receiving material passes through the fixing nip. In this embodiment the fixing member may be in a form of a transfer belt. The unfixed toner particles may be deposited upon the fixing member by any means known in the art, such as described in U.S. Pat No. 5,805,967 (De Bock et al./Xeikon NV).

Brief Description of the Drawing

The invention will be described in further detail, purely by way of example, with reference to the accompanying drawings, in which.

Detailed Description

Figure 1:
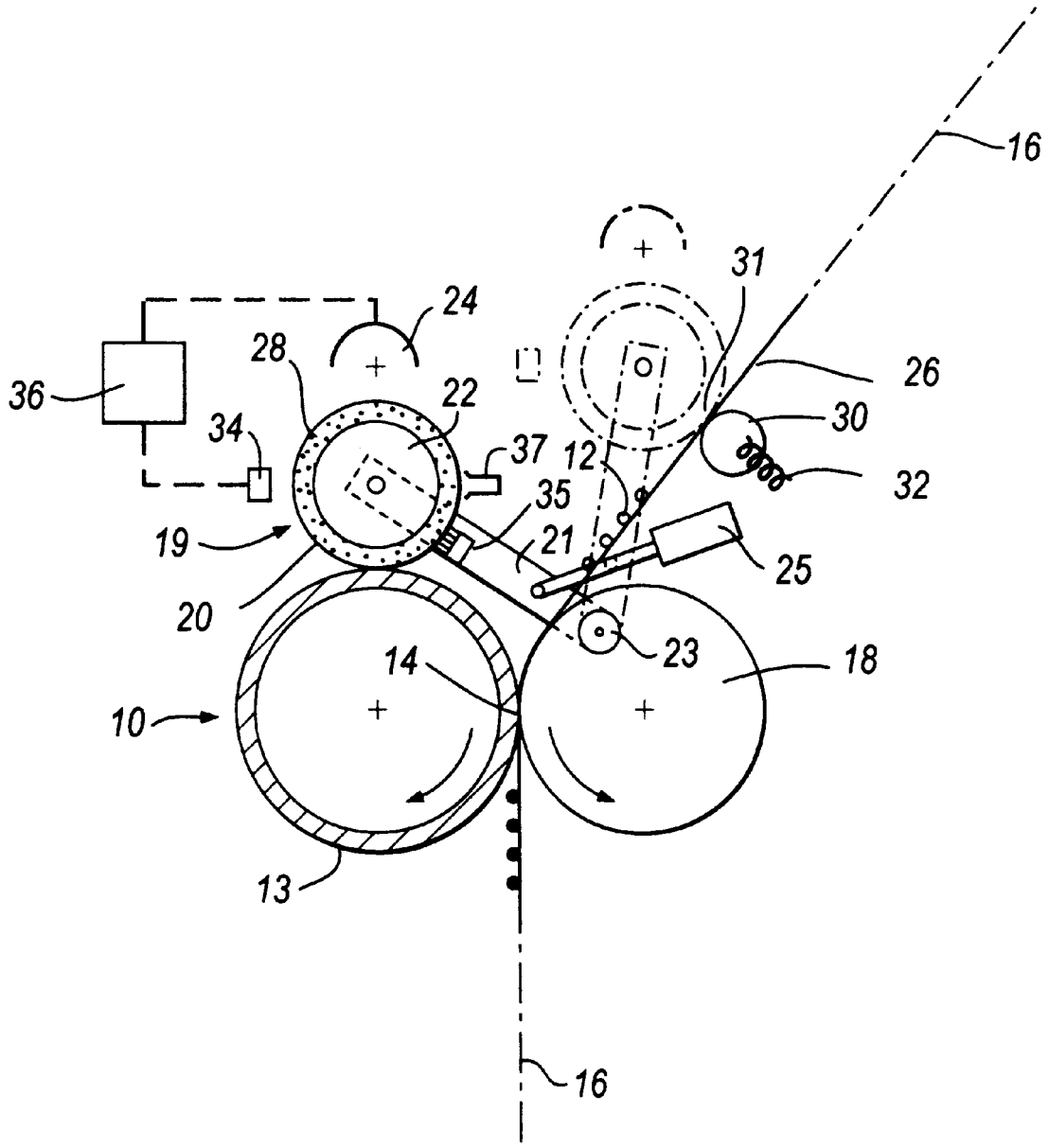
FIG. 1 is a diagrammatic illustration of one embodiment of a fixing device according to the invention.

FIG. 1 shows a fixing device for fixing toner images which have been deposited in image form onto a paper web 26 by an electrostatographic printer. The device comprises a heated fixing drum 10 urged into contact with a counter roller 18 to form a fixing nip 14 therebetween through which a path 16 for the paper web extends. The fixing drum 10 has a dry elastomeric outer layer, the surface 13 of which is coated with a silicone material. Unfixed toner particles 12 in image form are deposited on the paper web 26 by means not shown upstream of the fixing nip 14 and are fixed on the paper web 26 as it passes through the fixing nip 14.

A cleaning roller 19 has its surface 20 in rolling contact with the surface 13 of the fixing drum 10 to remove paper debris therefrom. The cleaning roller 19 comprises rigid metal core 22 provided with a conformable EPDM covering 28. The conformable covering has a hardness of 60 Shore A and a thickness of 7.5 mm. A radiant heater 24 is positioned adjacent the cleaning roller 19.

The cleaning roller 19 is carried on supporting arms 21 which can be pivoted about a pivot point 23 by operation of a solenoid 25 to normally position the cleaning roller 19 to contact the fixing drum 10 upstream of the fixing nip 14 but from time to time can be moved from this cleaning position through an intermediate neutral position (not shown) into a rejuvenation or toner pick-up position as shown in broken. lines in FIG. 1 in which the cleaning roller surface 20 contacts the paper web 26. In this toner pick-up position, the cleaning roller 19 co-operates with a back-up roller 30 to form a toner pick-up nip 31 therebetween through which the paper web path 16 extends, upstream of the fixing nip 14. An adjustable spring 32 is provided tc) adjust the pressure exerted between the cleaning roller 19 and the back-up roller 30 at the toner pick-up nip 31. In place of the adjustable spring 32, adjustment of the nip pressure may be achieved by control of the solenoid 25.

In the toner pick-up position, a band of toner particles deposited on paper web 26 by the printer is applied to the cleaning roller 19 fErom the paper web 26. These toner particles are heated on the cleaning roller surface 20 by the heater 24 to render the surface 20 tacky prior to contact of the cleaning roller surface 20 with the fixing drum surface 13. The heating of the toner particles 12 is controlled to ensure that the temperature thereof is raised to a level between the softening point and the fluid point of the toner. The temperature of the toner particles on the cleaning roller surface 20 is sensed by the temperature sensor 34, which generates signals to a control device 36 for controlling the output of the heater 24.

Subsequently, built-up toner and paper debris must be removed from the cleaning roller 19. This is achieved by cooling the cleaning roller 19 to a temperature below the softening point of the toner to thereby harden the built-up toner and paper debris mixture. The hardened mixture is removed from the cleaning roller 19 by abrasion by a brush 35 and picked-up by a vacuum device 37.

Figure 2:
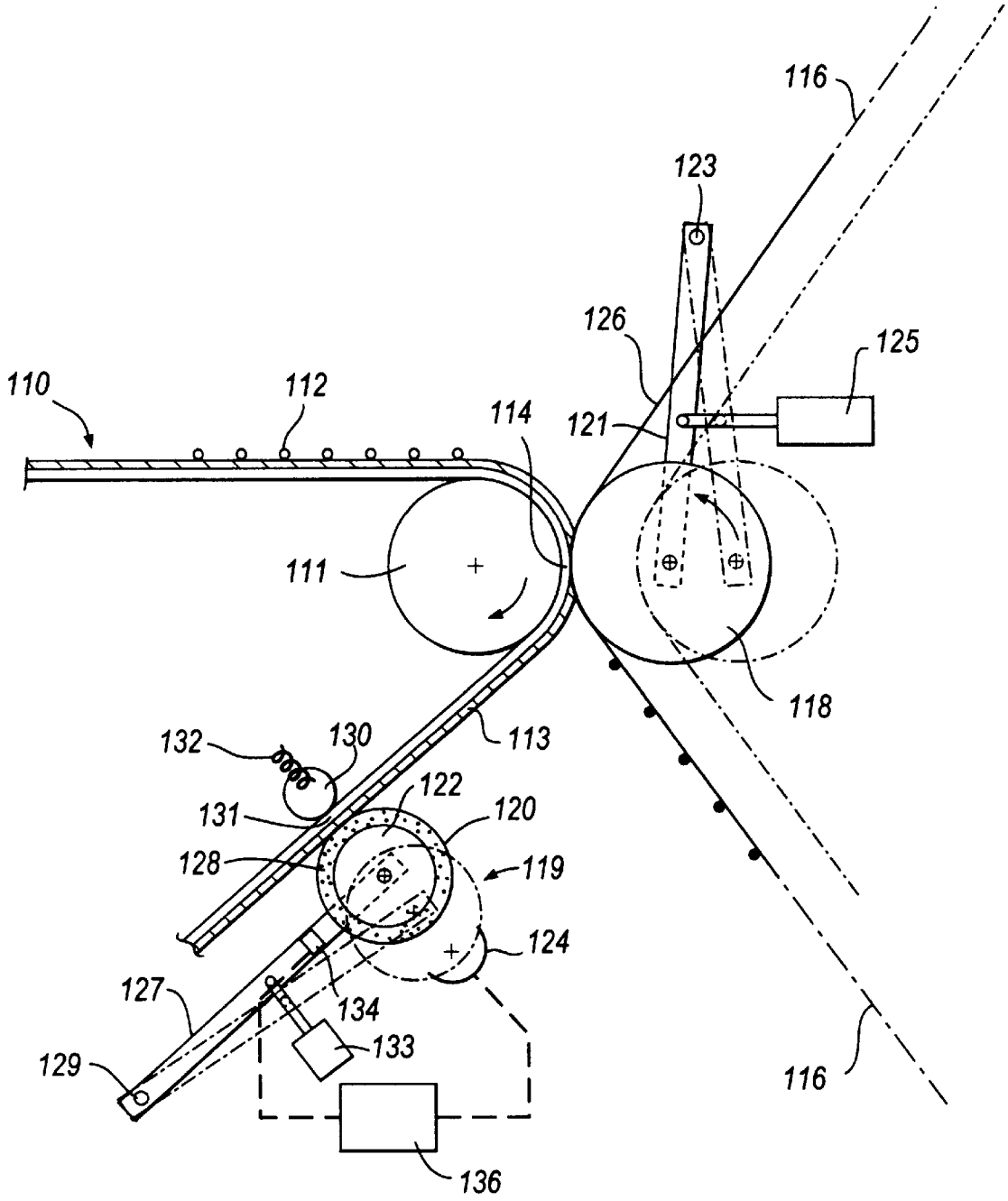
FIG. 2 is a diagrammatic illustration of another embodiment of a fixing device according to the invention.

FIG. 2 shows a trans-fixing device for simultaneously transferring and fixing toner images onto a paper web 126. The device comprises a transfer belt 110 urged into contact with a counter roller 118 to form a trans-fixing nip 114 therebetweern through which a path 116 for the paper web 126 extends. Unfixed toner particles 112, which have been deposited onto the transfer belt 110 in image form by an electrostatographic printer, are deposited on the transfer belt by means not shown upstream of the trans-fixing nip 114 and are transferred to the paper web 126 and fixed thereon as the paper web 126 passes through the transfixing nip 114. The transfer belt 110 has a dry el(astomeric outer layer, the surface 113 of which is coated with a silicone material and passes over a heated ,support roller 111 at the trans-fixing nip 114.

A cleaning roller 119 has its surface 120 in rolling contact with the surface 113 of the transfer belt 110 to remove paper debris therefrom. The cleaning roller 119 comprises a rigid metal core 122 provided with a conformable EPDM covering 128. The conformable covering has a hardness of 60 Shore A and a thickness of 7.5 mm. A radiant heater 124 is positioned adjacent the cleaning roller 119.

The cleaning roller 119 co-operates with a back-up roller 130 to form a cleaning nip 131 therebetween through which the transfer belt 110 passes, downstream of the trans-fixing nip 114. The cleaning roller 119 is carried on supporting arms 127 which can be pivoted about a pivot point 129 by operation of a solenoid 133 to normally position the cleaning roller 119 to contact the surface 113 of the transfer belt 110. An adjustable spring 132 is provided to adjust the pressure exerted between the cleaning roller 119 ar.d the back-up roller 130 at the cleaning nip 131. In place of the spring 132, adjustment of the nip pressure may be achieved by control of the solenoid 133.

The counter roller 118 is carried on supporting arms 121 which can be pivoted about a pivot point 123 by operation of a solenoid 125 to ena.ble the counter roller 118, from time to time, to be moved in a direction away from the transfer belt 110 to the position shown in broken lines in FIG. 2 to open the trans-fixing nip 114, thereby to prevent the trans-fixing of toner particles 112 on the paper web. This enables the transfer of a band of toner particles deposited on the transfer belt 110 by the printer is applied onto the cleaning roller surface 120.

Toner particles applied to the cleaning roller 119 in this manner are then heated by the heater 124 to a temperature between the softening point of the toner and the fluid point thereof, to render the surface 120 tacky prior to contact of the cleaning roller surface 120 with the transfer belt surface 113. The temperature of the toner particles on the cleaning rc)ller surface 120 is sensed by the temperature sensor 134, which generates signals to a control device 136 for controlling the output of the heater 124.

The cleaning roller 119 can be selectively moved from the cleaning position into a retracted position in which the cleaning roller surface 120 is not in contact with the transfer belt surface 113 while toner images 112 are being trans-fixed in the trans-fixing nip 114.

We claim:

1. A fixing device for fixing toner images onto a receiving material, the device comprising:

an endless fixing member urged into contact with an endless counter member to form a fixing nip therebetween through which a receiving material path extends;

a cleaning member having a tacky surface in contact with the surface of said fixing member;

means for applying polymer material particles to said cleaning member to render said surface tacky;

a controllable radiant heating device positioned adjacent said cleaning member surface for heating said polymer material particles on said cleaning member surface to render said surface tacky prior to contact of said cleaning member surface with said fixing member surface; and means for controlling said radiant heating device thereby to control the heating of said polmer material particles.

2. A fixing device according to claim 1, wherein said cleaning surface is an endless surface.

3. A fixing device according to claim 2, wherein said fixing member is in the form of a drum or a transfer belt.

4. A fixing device according to claim 2, wherein said fixing member has an elastomeric outer layer consisting of, or coated with, a silicone or a fluorsilicone material.

5. A fixing device according to claim 3, wherein said cleaning member is a cleaning roller comprising a rigid core provided with a conformable covering.

6. A fixing device according to claim 3, wherein said cleaning member is selectively movable from a cleaning position in which said cleaning member surface is in contact with said fixing member surface into a toner pick-up position in which said cleaning member surface abuts said receiving material path.

7. A fixing device according to claim 6, wherein said fixing member is a transfer belt and said cleaning member is a cleaning roller which co-operates with a back-up roller to form a cleaning nip therebetween through which said transfer belt passes, and said fixing device further comprises means to adjust the pressure between said cleaning roller and said back-up roller at said cleaning nip.

8. A fixing device for fixing toner images onto a receiving material comprising:

an endless fixing member urged into contact with an endless counter member to form a fixing nip therebetween through which a receiving material path extends;

a retractable cleaning member having a tacky surface in contact with the surface of said fixing member;

a contollable radiant heating device positioned adjacent said cleaning member surface for heating said polymer on said cleaning surface to adjust tackiness thereof prior to contact of said cleaning member surface with said fixing member surface; and means for controlling said radiant heating device thereby to contol the heating of said polymer material particles.

9. A fixing device according to claim 8, wherein said fixing member is a transfer belt and said cleaning member is a cleaning roller which co-operates with a back-up roller to form a cleaning nip therebetween through which said transfer belt passes, and said fixing device further comprises means to adjust the pressure between said cleaning roller and said back-up roller at said cleaning nip.

10. A fixing device according to claim 9, wherein said cleaning roller is a perforated roller.

11. A fixing device according to claim 10, wherein said cleaning roller comprises an inner core provided with a conformable covering.

12. A method of removing debris from the surface of an endless fixing member of a fixing device in which said fixing member is urged into contact with an endless counter member to form a fixing nip therebetween through which receiving material passes, the method comprising the steps of:

contacting said surface of said fixing member with a cleaning member having a tacky surface;

applying polymer material particles to said cleaning member;

heating said polymer material particles on said cleaning member surface by the use of a radiant heating device positioned adjacent said cleaning member surface to render said surface tacky prior to contact of said cleaning member surface with said fixing member surface; and controlling said radiant heating device to thereby control the heating of said polymer material particles.

13. A method according to claim 12, further comprising the subsequent step of removing built-up polymer material and debris from said cleaning member.

14. A method according to claim 13, wherein the temperature of said fixing member and said cleaning member is adjusted to ensure transfer of said built-up polymer material and debris from said cleaning member to said fixing member and subsequently transferring said built-up polymer material and debris from said fixing member to a waste portion of said receiving material.

15. A method according to claim 13, further comprising the steps of cooling said cleaning member to harden said built-up polymer material and debris and subsequently mechanically removing the hardened built-up polymer material and debris from said cleaning member.

16. A method according to claim 15, wherein said hardened built-up polymer material and debris is removed from said cleaning member by abrasion and vacuum pick-up.

17. A method according to claim 12, wherein said polymer material particles are comprised by toner particles.

* * * * *